US005255410A

United States Patent [19]

Stein et al.

[11] Patent Number: 5,255,410

[45] Date of Patent: Oct. 26, 1993

[54] VACUUM CLEANER

[75] Inventors: Klaus Stein; Heinz Kaulig, both of Velbert, Fed. Rep. of Germany

[73] Assignee: Stein & Co. GmbH, Velbert, Fed. Rep. of Germany

[21] Appl. No.: 842,025

[22] Filed: Feb. 26, 1992

Related U.S. Application Data

[63] Continuation-in-part of Ser. No. 747,185, Aug. 19, 1991.

[30] Foreign Application Priority Data

Feb. 26, 1991 [DE] Fed. Rep. of Germany ..... 4105996

[51] Int. Cl.[5] ..... A47L 5/30

[52] U.S. Cl. ..... 15/351; 15/366; 15/383; 152/310

[58] Field of Search ..... 15/351, 383, 366, 41.1; 152/246, 310

[56] References Cited

U.S. PATENT DOCUMENTS

| | | | |
|---|---|---|---|
| 837,936 | 12/1906 | King | 15/41.1 |
| 1,140,752 | 5/1915 | Leonard | 152/310 |
| 2,166,777 | 7/1939 | Smith | 15/41.1 |
| 2,898,622 | 8/1959 | Hurd | 15/350 X |
| 2,975,461 | 3/1961 | Hansen | 15/410 X |
| 3,031,710 | 5/1962 | Huening | 15/350 X |
| 5,090,464 | 2/1992 | Kauzlarich et al. | 152/310 |

*Primary Examiner*—Chris K. Moore
*Attorney, Agent, or Firm*—Nils H. Ljungman

[57] ABSTRACT

A vacuum cleaner generally has a working head which is positioned on the floor surface when the machine is in use. The working head of a vacuum cleaner essentially includes a rotating brush, a suction blower and a motor for operating both the brush and the blower. In addition, this working head also generally requires a spacing device, such as a wheel for guiding the brush head or suction brush head and controlling its proper spacing in relation to the floor.

17 Claims, 3 Drawing Sheets

VACUUM CLEANER

CROSS REFERENCE TO RELATED APPLICATION

This application is a continuation in part of pending application Ser. No. 07/747,185, entitled "Brush Type Vacuum Cleaner", which was filed on Aug. 19, 1991 in the names of Klaus Stein and Heinz Kaulig, the inventors herein, which application is incorporated by reference herein.

BACKGROUND OF THE INVENTION

1. Field of the Invention

This invention relates to floor care machines, such as vacuum cleaners, which have a working head which is positioned on the floor surface when the machine is in use. The working head of a vacuum cleaner generally includes a rotating brush, a suction blower and a motor for operating both the brush and the blower. In addition, this working head also generally requires a spacing device, such as a wheel for guiding the vacuum cleaner and controlling the proper spacing between the working head and the floor.

2. Background Information

With the vacuum cleaner of the present invention, one motor is provided for operating the suction blower as well as the cleaning brush. The cleaning brush is driven simultaneously with the suction blower by means of additional drive devices such as drive belts. Since all of the heaviest components of the vacuum cleaner are mounted in the brush-suction head which rolls along the ground, the load that the user experiences may be kept particularly low.

On the other hand, this configuration therefore results in a heavier brush-suction head, which brush suction head is generally guided along the floor on a set of wheels. The wheels also generally provide the spacing between the brush-suction head and the floor so that a proper brushing of the floor is achieved. That is, depending on the height or pile of the carpet, the height between the brushes and the carpet can be adjusted so that the brushes contact the carpet with sufficient brushing action as the brushes rotate.

Wheels for such a vacuum cleaner also generally need to make it possible for the machine to be moved back and forth on the floor relatively easily. Typically, the wheels are made of a hard material, such as metal or hard plastic, and these types of wheels have significant disadvantages, particularly when they are run over hard floors, in particular stone floors with joints and seams. As such a device with hard wheels is run over joints or seams in hard floor, hard impacts are transmitted to the device, and these impacts generally result in relatively loud noises.

To achieve damping or suspension effects, of course, the prior art has equipped such machines with wheels which support a soft and elastic tire about the circumference of the wheels. However, it has been shown that satisfactory results can only be achieved with such a soft and elastic tire if the tire is relatively soft and thick. These soft and thick tire arrangements, however, result in excess wear of the tire, resulting in the frequent need for tire replacement, and the machine leaves streaks on the floor. Further, if the machine is allowed to sit idle for a long period of time, that is, with the same portion of the tire in continuous contact with the floor, permanent deformations of the tire occur, and these permanent deformations in turn, cause noisy and bumpy operation of the machine.

These disadvantages can of course be eliminated by a wear-resistant tire material which also resists permanent deformations. But, with such a wear-resistant tire arrangement, the tire cannot be sufficiently elastic, and therefore, when the tire is in contact over its entire surface with the roll body, or hub, the damping effect of the tire is very small.

OBJECT OF THE INVENTION

The object of the invention is to create a floor care machine, such as a vacuum cleaner, which has a wheel of the generic type described above, which, by means of simple measures, makes possible a sufficient degree of damping using wear resistant materials, guarantees good functionality by making possible damped travel on hard floors, and does not leave streaks on any floors.

SUMMARY OF THE INVENTION

This object is achieved by means of the invention, in a floor care machine, or vacuum cleaner, which has a wheel in which a portion of the cylindrical surface of the roll body of the wheel is formed by a tire made of wear-resistant elastic material as a projecting running surface, and which elastic material is held in place in a groove-shaped seat of the roll body. Underneath the tire, the groove-shaped seat has a deflection space into which the tire can deflect upon impact, and the running surface of the tire is formed by a raised, projecting cylindrical surface.

It thereby becomes possible for the tire to deflect into the deflection space located underneath the tires bottom surface, so that the above-mentioned conditions with regard to damping, wear, functionality and streaking, can be met.

In a simple embodiment for mounting the tire, the groove-shaped seat is preferably indented in a stepped fashion.

The invention also proposes that the roll body be formed preferably by two partial elements which are assembled together by means of spokes and/or tabs.

One aspect of the invention resides broadly in a vacuum cleaner for vacuuming an object such as a floor. The vacuum cleaner comprises: a housing having a first end and a second end. The first end of the housing comprises a floor suction component, and the floor suction component comprises: suction apparatus for withdrawing at least air from the vicinity of the floor, an outlet for emitting the withdrawn air from the floor suction component, a rotating brush device for dislodging dirt and the like from the floor, and at least one wheel device for movement of the housing along the floor. The second end of the housing comprises a filter housing, and the filter housing comprises: a filter apparatus for filtering at least the air withdrawn by the suction apparatus, and a device for connecting the suction apparatus to the filter apparatus. The at least one wheel device comprises a wheel body, and the wheel body has a surface about the circumference of the wheel body. The wheel body comprises: a circumferential groove disposed about the circumference, the circumferential groove having a base and a top, and an elastomeric tire at least partially disposed within the circumferential groove, the elastomeric tire having a base portion disposed toward the base of the circumferential groove, and a protruding portion for protruding beyond the circumference of the wheel body. The base portion of the tire is spaced apart from the base portion of the circumferential groove.

Another aspect of the invention resides broadly in a floor care machine such as a vacuum cleaner, the floor care machine comprising: a housing having a first end and a second end. The first end of the housing comprises a working head, and the working head comprises: at least one wheel device for movement of the housing along the floor, and at least one of: suction device for withdrawing at least air from the vicinity of the floor; a device for dislodging dirt and the like from the floor; and a brush device for polishing the floor. The second end of the housing comprises a handle device for guiding the floor care machine along the floor. The at least one wheel device comprises a wheel body, and the wheel body has a surface about the circumference of the wheel body. The wheel body comprises: a circumferential groove disposed about the circumference, the circumferential groove having a base and a top, and an elastomeric tire at least partially disposed within the circumferential groove, the elastomeric tire having a base portion disposed toward the base of the circumferential groove, and a protruding portion for protruding beyond the circumference of the wheel body. The base portion of the tire is spaced apart from the base portion of the circumferential groove.

One additional aspect of the invention resides broadly in a wheel for use in a floor care machine. The wheel comprises: a wheel body, and the wheel body has a surface about the circumference of the wheel body. The wheel body comprises: a circumferential groove disposed about the circumference, the circumferential groove having a base and a top, and an elastomeric tire at least partially disposed within the circumferential groove, the elastomeric tire having a base portion disposed toward the base of the circumferential groove and a protruding portion for protruding beyond the circumference of the wheel body. The base portion of the tire is spaced apart from the base of the circumferential groove.

BRIEF DESCRIPTION OF THE DRAWINGS

One embodiment of the invention is schematically illustrated in the accompanying drawings, in which.

DESCRIPTION OF THE PREFERRED EMBODIMENTS

Figure 1:
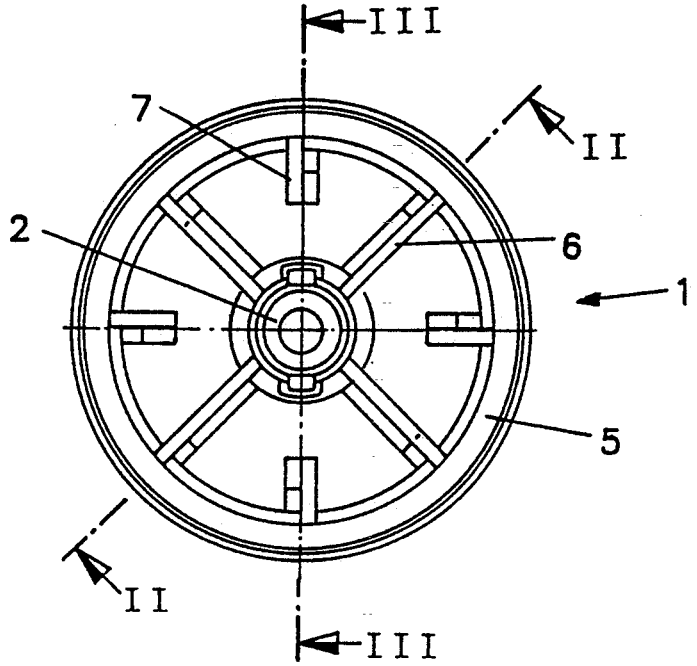
FIG. 1 shows a side view of a wheel for the brush-suction head of the vacuum cleaner.
Figure 1A:
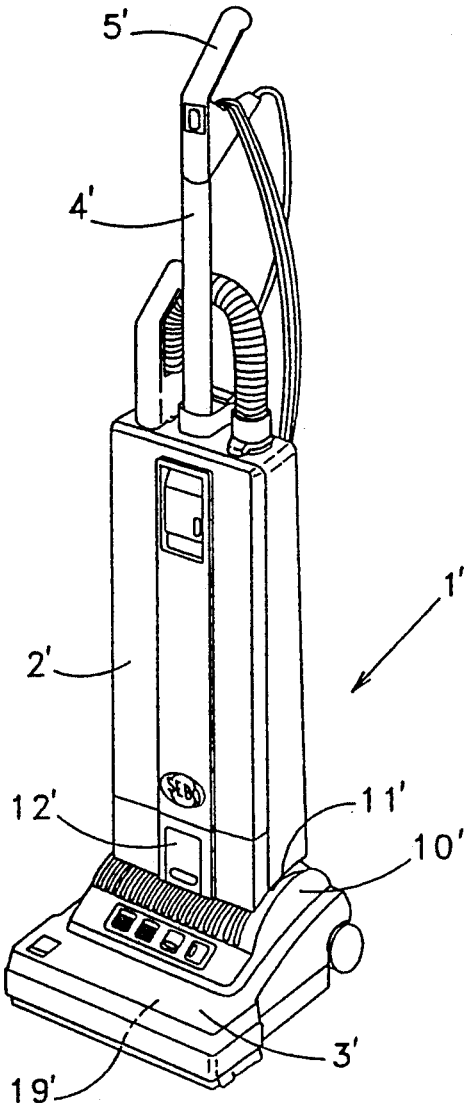
FIG. 1A is a perspective view of a brush-type vacuum cleaner of the present invention.
Figure 1B:
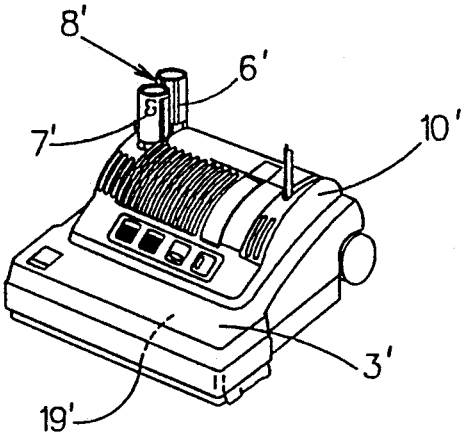
FIG. 1B is a perspective view of the brush-suction head of the vacuum cleaner of FIG. 1A.
Figure 1C:
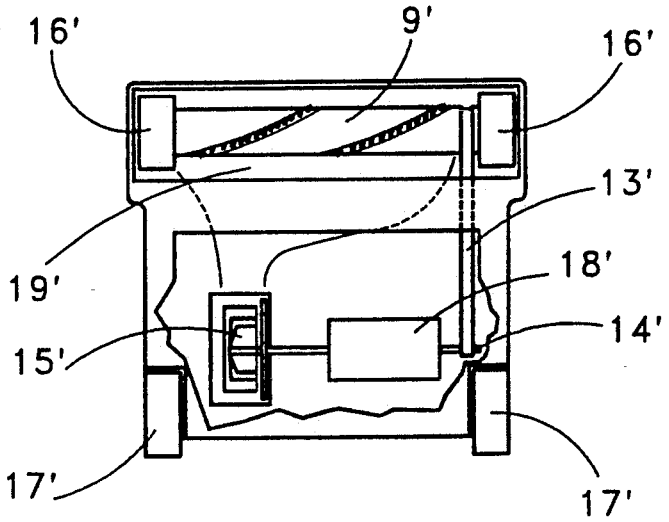
FIG. 1C is a cut-away bottom view of the brush-suction head of the vacuum cleaner of FIG. 1A.

FIGS. 1A–1C show a brush-type vacuum cleaner 1' a the individual elements comprising the vacuum cleaner 1'. Vacuum cleaner 1' includes filter housing 2' and brush-suction head 3'. Brush-suction head 3' may be replaced by a non-brush type suction head. Filter housing 2' is equipped with a handle comprising shaft 4' and grip 5'. Filter housing 2' may also include an air filter such as a filter bag. Brush-suction head 3' includes a motor that drives the suction blower and, also, simultaneously drives a cleaning brush by means of drive belts. Such filter bags, motors, cleaning brushes and drive belts are well known in the art. Filter housing 2' and brush-suction head 3' are connected to one another by means of a pivoting connection such as connector, or guide element 8'.

With brush-type vacuum cleaner 1', the suction air generated may travel from the vacuum mouthpiece of brush-suction head 3' and into filter housing 2' via channel 6'. Channel 6' may act as an inlet line for the dirt-laden suction air. From filter housing 2', the air may travel via channel 7', wherein channel 7' may be parallel to channel 6', and back to brush-suction head 3'.

Brush-suction head 3' is equipped with connector 8', which connector 8' facilitates the pivoting of filter housing 2' with brush-suction head 3'. Connector 8' is mounted so that it can pivot in brush-suction head 3' such as in a corresponding receptacle that may form a part of brush-suction head 3'. Connector 8' contains outward-leading channels 6' and 7', wherein channels 6' and 7' may be parallel to one another. The ends of channels 6' and 7' form an attachment for the mounting of filter housing 2' with coordinated continuing channels in filter housing 2' and/or brush-suction head 3'.

Brush-suction head 3' is equipped in the connection area with diagonally running guide 10' which is alignable with a corresponding receptacle 11' of filter housing 2'. Guide 10' may define a curved surface or a partially circular surface. The connection of connector 8' to the filter housing 2' is maintained via a locking element (not shown) which can be released by a corresponding release button 12' on filter housing 2'.

A possible location for the releasable connection of an electrical lead from filter housing 2' to brush-suction head 3' is the vicinity adjacent attachment, or guide element or connector 8'. This connection may be a standard and well known type of electrical connection.

In the vicinity of brush-suction head 3' and inside attachment, or guide element or connector, 8', channel 7' is for being connected with the suction blower (not shown). Channel 6' is for being connected with vacuum mouthpiece 19' of brush-suction head 3'.

By means of this double channel connection between filter housing 2' and brush-suction head 3', a mechanical coupling is created which also ensures a separate air conduction independent of the pivot position.

As shown in FIG. 1C, the brush-suction head of the vacuum cleaner preferably has a brush roller 9' which is connected via belt 13' to a motor shaft 14' of a motor 18'. The motor shaft 14' can also directly drive a suction blower 15' to suck air in through vacuum mouthpiece 19'.

In addition, the brush-suction head 3' can also preferably have four wheels to carry and guide the brush suction 3' head over the surface being cleaned. Two front wheels 16' and two rear wheels 17'. The two front wheels 16' can be an integral part of the brush roller 9' or they can be separate therefrom, and generally are adjustable relative to the floor to vary the height between the brush roller 9' and floor being cleaned. The back wheels 17' are generally fixed with respect to the brush suction head 3', but depending on the desired operation of any floor care machine, the back wheels can also be adjustable to vary the height between the floor and the brush suction head 3' at the back end of the brush-suction head 3'.

Figure 2:
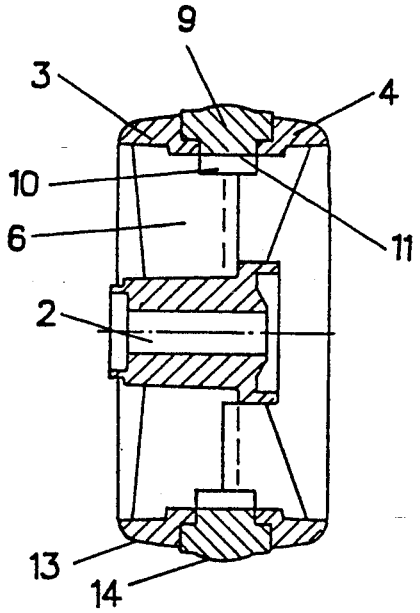
FIG. 2 shows a cross section taken along Line II—II in FIG. 1.
Figure 3:
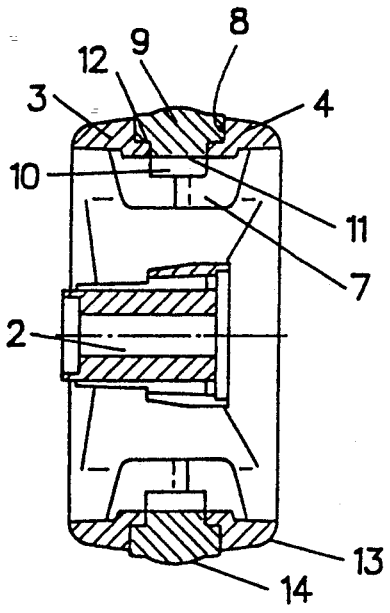
FIG. 3 shows a cross section taken along Line III—III in FIG. 1.

These wheels are described in greater detail with reference to FIGS. 1-3. In FIGS. 1-3, the illustrated wheel has a hub 2, and preferably consists of two assembled matching partial wheel elements 3 and 4 which, when assembled, form a roll body 5. The partial wheel elements 3 and 4 are preferably connected to one another by means of spokes 6 and tabs 7.

In the plane separating the partial wheel elements 3 and 4, there is preferably a groove-shaped seat 8 for receipt of an elastic tire 9. Underneath the bottom surface 11 of the tire 9, there is preferably a deflection space 10. In the embodiment shown, the groove-shaped seat 8 preferably has a stepped indentation 12 to hold the tire 9, and the tire 9 is also preferably correspondingly indented to thereby match the indentation 12. The roll surface 14 of the tire 9 also preferably projects beyond the roll surface 13 of the roll body 5, and thereby forms a preferably raised, rounded cylindrical surface. The size of this projection can be designed so that edges or doorsills in the floor preferably do not strike the hard roll body 5.

As a result of this embodiment according to the present invention, it is possible to achieve a high damping effect with the use of a tire material that is characterized by low wear and high recovery. This is essentially the case since, as a result of the deflection space 10, the base surface 11 of the tire 9 is not in contact with anything and therefore can undergo unobstructed deflection into the space 10.

While the present invention has been disclosed with respect to a brush type vacuum cleaner, it is to be understood that the present invention is equally usable in non-brush type vacuum cleaners, also.

In summary, one feature of the invention resides broadly in a wheel for floor care machines, in particular for brush vacuum cleaners, to guide the brush head or suction brush head and/or to keep it at the proper distance in relation to the floor. The wheel consists of a wheel body with a hub, characterized by the fact that a portion of the cylindrical surface of the roll body 5 is formed by a tire 9 made of elastic material as the projecting running surface, and is held in a groove-shaped seat 8 of the roll body 5, whereby underneath the installed tire 9 the groove-like seat has a deflection space 10, and the running surface of the tire 9 is formed by a raised projecting cylindrical surface.

Another feature of the invention resides broadly in a wheel characterized by the fact that the groove-shaped seat 8 is indented in a stepped fashion.

Yet another feature of the invention resides broadly in a wheel characterized by the fact that the roll body 5 is formed by two partial wheel elements 3 and 4 which are assembled by means of spokes 6 and/or tabs 7.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A vacuum cleaner for vacuuming an object such as a floor, said vacuum cleaner comprising:

a housing, said housing having a first end and a second end;

said first end of said housing comprising a floor suction component, and said floor suction component comprising:

suction means for withdrawing at least air from vicinity of the floor;

rotating brush means for dislodging dirt and the like from the floor; and at least one wheel means for movement of said housing along the floor;

said second end of said housing comprising a filter housing, and said filter housing comprising:

filter means for filtering at least the air withdrawn by said suction means; and means for connecting said suction means to said filter means; and said at least one wheel means comprising:

a wheel body, said wheel body having a circumference and an axis of rotation, the axis of rotation defining an axial direction of said wheel body, said wheel body comprising:

a first side portion and a second side portion, said second side portion being spaced apart from said first side portion in the axial direction to define an opening therebetween about the circumference of the wheel body;

each of said first side portion and said second side portion having a surface disposed about the circumference of the wheel body;

an elastomeric tire at least partially disposed within said circumferential opening, said elastomeric tire having a base portion disposed within said circumferential opening, and a protruding portion for protruding beyond the circumferential surface of each of said first side portion and said second side portion;

the circumferential opening between said first side portion and said second side portion extending radially from said base portion of said elastomeric tire towards said axis of rotation to form a circumferential space adjacent said base portion of said elastomeric tire and extending radially from said base portion of said elastomeric tire towards said axis of rotation;

said base portion of said tire being configured to deform radially into said space in a direction toward said axis of rotation upon application of a pressure on said protruding portion in a direction towards said axis of rotation, and said space being configured to accept the deformation of said elastomeric tire thereinto;

the circumferential surfaces of both of said first side portion and said second side portion define a curved profile of the wheel body in the axial direction of the wheel body;

said circumferential opening is disposed at the apex of the curved profile; and said protruding portion of the elastomeric tire defines the apex of said wheel body.

2. The vacuum cleaner according to claim 1, wherein:

said tire has a first width at said protruding portion and a second width at said base portion;

said circumferential opening has a first width adjacent said protruding portion of said elastomeric tire and a second width adjacent said base portion of said elastomeric tire;

the first width of said circumferential opening is greater than the second width of said circumferential opening; and the first width of said tire at said protruding portion is greater than the second width of said tire at said base portion.

3. The vacuum cleaner according to claim 2, wherein:

said first side portion has a first side defining a first side of said circumferential opening, and said second portion has a first side defining a second side of said circumferential opening; and each of said first side of said first side portion and said first side of said second side portion has a stepped configuration.

4. The vacuum cleaner according to claim 3, wherein:

said elastomeric tire has a first side disposed adjacent said first side of said first side portion and a second side disposed adjacent said first side of said second side portion; and each of said first side and said second side of said elastomeric tire has a stepped configuration, said stepped configuration of said sides of said elastomeric tire substantially corresponding to said stepped configuration of said first sides of each of said first side portion and said second side portion.

5. The vacuum cleaner according to claim 4, wherein:

said wheel body comprises a first wheel body portion and a second wheel body portion;

said first wheel body portion comprises said first side portion;

said second wheel body portion comprises said second side portion; and at least one of said first wheel body portion said second wheel body portion comprises fastening means for fastening said first wheel body portion to said second wheel body portion.

6. The vacuum cleaner according to claim 5, wherein said fastening means comprises at least one of:

spokes and tabs.

7. A floor care machine such as a vacuum cleaner, said floor care machine comprising:

a housing, said housing having a first end and a second end;

said first end of said housing comprising a working head, and said working head comprising:

at least one wheel means for movement of said housing along the floor; and at least one of:

suction means for withdrawing at least air from the vicinity of the floor;

means for dislodging dirt and the like from the floor; and brush means for polishing the floor;

said second end of said housing comprising handle means for guiding said floor care machine along the floor; and said at least one wheel means comprising:

a wheel body, said wheel body having circumference and an axis of rotation, the axis of rotation defining an axial direction of said wheel body, said wheel body comprising:

a first side portion and a second side portion, said second side portion being spaced apart from said first side portion in the axial direction to define an opening therebetween about the circumference of the wheel body;

each of said first side portion and said second side portion having a surface disposed about the circumference of the wheel body;

an elastomeric tire at least partially disposed within said circumferential opening, said elastomeric tire having a base portion disposed within said circumferential opening, and a protruding portion for protruding beyond the circumferential surface of each of said first side portion and said second side portion;

the circumferential opening between said first side portion and said second side portion extending radially from said base portion of said elastomeric tire towards said axis of rotation to form a circumferential space adjacent said base portion of said elastomeric tire and extending radially from said base portion of said elastomeric tire towards said axis of rotation;

said base portion of said tire being configured to deform radially into said space in a direction toward said axis of rotation upon application of a pressure on said protruding portion in a direction towards said axis of rotation and said space being configured to accept the deformation of said elastomeric tire thereinto; the circumferential surfaces of both of said first side portion and said second side portion define, a curved profile of the wheel body in the axial direction of the wheel body;

said circumferential opening is disposed at the apex of the curved profile; and said protruding portion of the elastomeric tire defines the apex of said wheel body.

8. The floor care machine according to claim 1, wherein:

said tire has a first width at said protruding portion and a second width at said base portion;

said circumferential opening has a first width adjacent said protruding portion of said elastomeric tire and a second width adjacent said base portion of said elastomeric tire;

the first width of said circumferential opening is greater than the second width of said circumferential opening; and the first width of said tire at said protruding portion is greater than the second width of said tire at said base portion.

9. The floor care machine according to claim 8, wherein:

said first side portion has a first side defining a first side of said circumferential opening, and said second side portion has a first side defining a second side of said circumferential opening; and each of said first side of said first side portion and said first side of said second side portion has a stepped configuration.

10. The floor care machine according to claim 9, wherein:

said elastomeric tire has a first side disposed adjacent said first side of said first side portion and a second side disposed adjacent said first side of said second side portion; and each of said first side and said second side of said elastomeric tire has a stepped configuration, said stepped configuration of said sides of said elastomeric tire substantially corresponding to said stepped configuration of said first sides of each of said first side portion and said second side portion.

11. The floor care machine according to claim 10, wherein:

said wheel body comprises a first wheel body portion and a second wheel body portion;

said first wheel body portion comprises said first side portion;

said second wheel body portion comprises said second side portion; and at least one of said first wheel body portion and said second wheel body portion comprises fastening means for fastening said first wheel body portion to said second wheel body portion.

12. The floor care machine according to claim 11, wherein said fastening means comprises at least one of: spokes and tabs.

13. In a floor care machine a wheel, said wheel comprising:

a wheel body, said wheel body having a circumference and an axis of rotation, the axis of rotation defining an axial direction of said wheel body, said wheel body comprising:

a first side portion and a second side portion, said second side portion being spaced apart from said first side portion in the axial direction to define an opening therebetween about the circumference of the wheel body;

each of said first side portion and said second side portion having a surface disposed about the circumference of the wheel body;

an elastomeric tire at least partially disposed within said circumferential opening, said elastomeric tire having a base portion disposed within said circumferential opening, and a protruding portion for protruding beyond the circumferential surface of each of said first side portion and said second side portion;

the circumferential opening between said first side portion and said second side portion extending radially from said base portion of said elastomeric tire towards said axis of rotation to form a circumferential space adjacent said base portion of said elastomeric tire and extending radially from said base portion of said elastomeric tire towards said axis of rotation;

said base portion of said tire being configured to deform radially into said space in a direction toward said axis of rotation upon application of a pressure on said protruding portion in a direction towards said axis of rotation and said space being configured to accept the deformation of said elastomeric tire thereinto;

the circumferential surfaces of both of said first side portion and said second side portion define a curved profile of the wheel body in the axial direction of the wheel body;

said circumferential opening is disposed at the apex of the curved profile; and said protruding portion of the elastomeric tire defines the apex of said wheel body.

14. The wheel according to claim 13, wherein:

said tire has a first width at said protruding portion and a second width at said base portion;

said circumferential opening has a first width adjacent said protruding portion of said elastomeric tire and a second width adjacent said base portion of said elastomeric tire;

the first width of said circumferential opening is greater than the second width of said circumferential opening; and the first width of said tire at said protruding portion is greater than the second width of said tire at said base portion.

15. The wheel according to claim 14, wherein:

said first side portion has a first side defining a first side of said circumferential opening, and said second side portion has a first side defining a second side of said circumferential opening; and each of said first side of said first side portion and said first side of said second side portion has a stepped configuration.

16. The wheel according to claim 15, wherein:

said elastomeric tire has a first side disposed adjacent said first side of said first side portion and a second side disposed adjacent said first side of said second side portion; and each of said first side and said second side of said elastomeric tire has a stepped configuration, said stepped configuration of said sides of said elastomeric tire substantially corresponding to said stepped configuration of said first sides of each of said first side portion and said second side portion.

17. The wheel according to claim 16, wherein:

said wheel body comprises a first wheel body portion and a second wheel body portion;

said first wheel body portion comprises said first side portion;

said second wheel body portion comprises said second side portion; and at least one of said first wheel body portion and said second wheel body portion comprises fastening means for fastening said first wheel body portion to said second wheel body portion; and said fastening means comprises at least one of: spokes and tabs.

* * * * *

UNITED STATES PATENT AND TRADEMARK OFFICE

CERTIFICATE OF CORRECTION

PATENT NO. : 5,255,410

DATED : October 26, 1993

INVENTOR(S) : Klaus STEIN and Heinz KAULIG

It is certified that error appears in the above-indentified patent and that said Letters Patent is hereby corrected as shown below:

In column 3, line 61, after ' 1' ', delete "a" and insert --as well as--.

In column 6, line 16, Claim 1, after 'from', insert --the--.

In column 7, lines 18 and 19, Claim 3, after the first occurrence of 'second', insert --side--.

In column 8, line 40, Claim 8, after 'claim', delete "1" and insert --7--.

Signed and Sealed this

Seventeenth Day of May, 1994

Bruce Lehman

*Attest:*

BRUCE LEHMAN

*Attesting Officer*

*Commissioner of Patents and Trademarks*